United States Patent [19]

Ries

[11] Patent Number: 4,740,758

[45] Date of Patent: Apr. 26, 1988

[54] APPARATUS FOR GENERATING A MAGNETIC FIELD IN A VOLUME HAVING BODIES INFLUENCING THE FIELD PATTERN

[75] Inventor: Günter Ries, Erlangen, Fed. Rep. of Germany

[73] Assignee: Siemens Aktiengesellschaft, Munich, Fed. Rep. of Germany

[21] Appl. No.: 826,105

[22] Filed: Feb. 5, 1986

[30] Foreign Application Priority Data

Feb. 15, 1985 [DE] Fed. Rep. of Germany ..... 3505281

[51] Int. Cl.[4] ..... H01J 1/50; H01J 3/34

[52] U.S. Cl. ..... 328/233; 313/154; 313/156

[58] Field of Search ..... 320/233, 234, 235; 313/359.1, 153, 154, 156

[56] References Cited

U.S. PATENT DOCUMENTS 3,005,954 10/1961 Heard ..... 328/233 X 4,047,068 9/1977 Ress et al. ..... 328/233 X

OTHER PUBLICATIONS

1972 Applied Superconductivity Conference, 1972, pp. 226, 230, 231 and 238.

IEEE Trans. on Nuclear Science, vol. NS-30, No. 4, 8/83, pp. 2531-2533.

Proceedings of the 8th Int'l Conf. on High-Energy Accelerators Cern 1971, Geneva, Switzerland, 1971, pp. 177-182.

*Primary Examiner*—David K. Moore

*Assistant Examiner*—K. Wieder

*Attorney, Agent, or Firm*—Kenyon & Kenyon

[57] ABSTRACT

Apparatus for generating a magnetic field having a spatially predetermined field pattern in a useful volume, where bodies of ferro-magnetic material influencing the field pattern are disposed in the useful volume. To assure a spatially predetermined field pattern in the useful volume with only small field errors, outside and on opposite sides of the useful volume at least one thin plate-shaped body of predetermined geometric extent comprising a material having high permeability is provided, of which the surfaces facing the useful volume are shaped and arranged so that the surfaces lie on a magnetic equipotential surface of the magnetic field to be generated in the useful volume.

11 Claims, 2 Drawing Sheets

APPARATUS FOR GENERATING A MAGNETIC FIELD IN A VOLUME HAVING BODIES INFLUENCING THE FIELD PATTERN

BACKGROUND OF THE INVENTION

The present invention relates to apparatus for generating a magnetic field having a spatially predetermined field pattern in a useful volume which is provided with bodies of ferro-magnetic material influencing the field pattern. Such apparatus are known, for instance, from DE-OS No. 25 26 845.

In apparatus by which magnetic fields can be generated, a spatially predetermined field pattern in a useful volume must frequently be adhered to with only small deviations. This applies, for instance, to particle accelerators in which deflection devices for charged particles such as electrons have suitably curved dipole magnets due to their curved particle tracks (see, for instance, "IEEE Transactions on Nuclear Science", Vol. NS-30, No. 4, Aug. 1983, pages 2531 to 2533). The predetermined field pattern is generated generally by a suitable shape and design of the current-carrying windings or also by ferro-magnetic pole pieces.

In the case of low magnetic field intensities or high field change rates, a number of interference sources distorting the field can become important so that then the field error limits to be maintained may be exceeded. Thus, one must think of external field disturbances such as the field of the Earth or magnetized objects as the cause of undesired field distortions. In addition, also eddy currents in metallic parts of the magnet itself or in the conductor can lead to such disturbances. Also, superconducting shielding currents in the filaments of a superconducting winding or the residual magnetization in an iron yoke represent such sources of disturbances. Finally, also the field of magnetizable, i.e., para-, ferri- or ferro-magnetic parts of magnetic apparatus can be the cause of field distortions.

In order to compensate for such field distortions, for instance, current-fed compensation windings can be provided which are frequently attached as a set of cylindrical multipole coils about the predetermined useful volume. These coils are fed by power supplies such that the previously measured field error is compensated in operation. Thus, for instance, a sextuple correction coil with a superconducting deflection magnet is known from the publication "Proc. 1972 Applied Supercond. Conf." Annapolis, U.S.A., pages 293 to 299.

Compensation of field distortion in a superconducting short-circuited multipole coil is also provided in the publication "Proc. 8th Int. Conf. on High-Energy Accelerators, CERN 1971", Geneva, Switzerland, 1971, pages 177 to 182. For this purpose, the undesired multipole error automatically induces, when running up the magnetic field, the coil current which is required for a compensation coil and then largely compensates this component in the useful volume. However, a separate coil is required for each multipole.

From DE-OS No. 25 26 845, magnetic apparatus for generating inhomogeneous magnetic fields is known which can be used, for instance, for magnetic ore separators. This magnetic apparatus has superconducting magnet coils in order to bring about the forces, depending on the product B grad B, on the particles to be separated. In order to generate a product B grad B as large as possible, bodies of ferro-magnetic material with higher field strength are provided in the known device.

SUMMARY OF THE INVENTION

It is an object of the present invention to provide apparatus for generating a magnetic field of the type mentioned above in which a spatially predetermined field pattern can be assured with only small field errors in a useful volume and in a simple manner.

The above and other objects of the invention are achieved by providing, outside and on opposite sides of the useful volume, at least one thin plate-shaped body of predetermined geometric extent comprising a material with high permeability, the surfaces of each body facing the useful volume being shaped and arranged such that they lie on a magnetic equipotential surface of the magnetic field to be generated in the useful volume.

The advantages connected with this embodiment of the apparatus for generating the magnetic field are in particular that magnetic interference field fluxes are equalized within the plate-shaped bodies and only the total flux penetrating the useful volume is given by the magnetic-field-generating devices to be arranged outside the useful volume. The extent of the plate-shaped bodies is advantageously chosen large enough, depending on the space situation, so that interference fields penetrating into the useful volume from the edges are greatly attenuated.

The influence of such interference fields on the magnetic field to be generated in the useful volume can advantageously be prevented, if superconducting magnets are used, by providing outside and on opposite sides of the useful volume, a grid or screen-like structure of predetermined extent with wire- or ribbon-shaped superconductors, where each structure is shaped and arranged in such a way that it follows the field lines of the magnetic field to be generated in the useful volume, and where the superconductors are aligned perpendicularly to the field lines and are connected at least at their ends to electrically conducting parts extending in the direction of the field lines. With this grid-like structure, it can then be prevented that changes in time of an interference field component can penetrate perpendicularly to the grid plane into the useful volume in that corresponding shielding currents are automatically induced in the wire or ribbon shaped superconductors.

BRIEF DESCRIPTION OF THE DRAWINGS

For a further explanation of the invention, reference is made in the following description to the drawings, in which.

DETAILED DESCRIPTION

Figure 1:
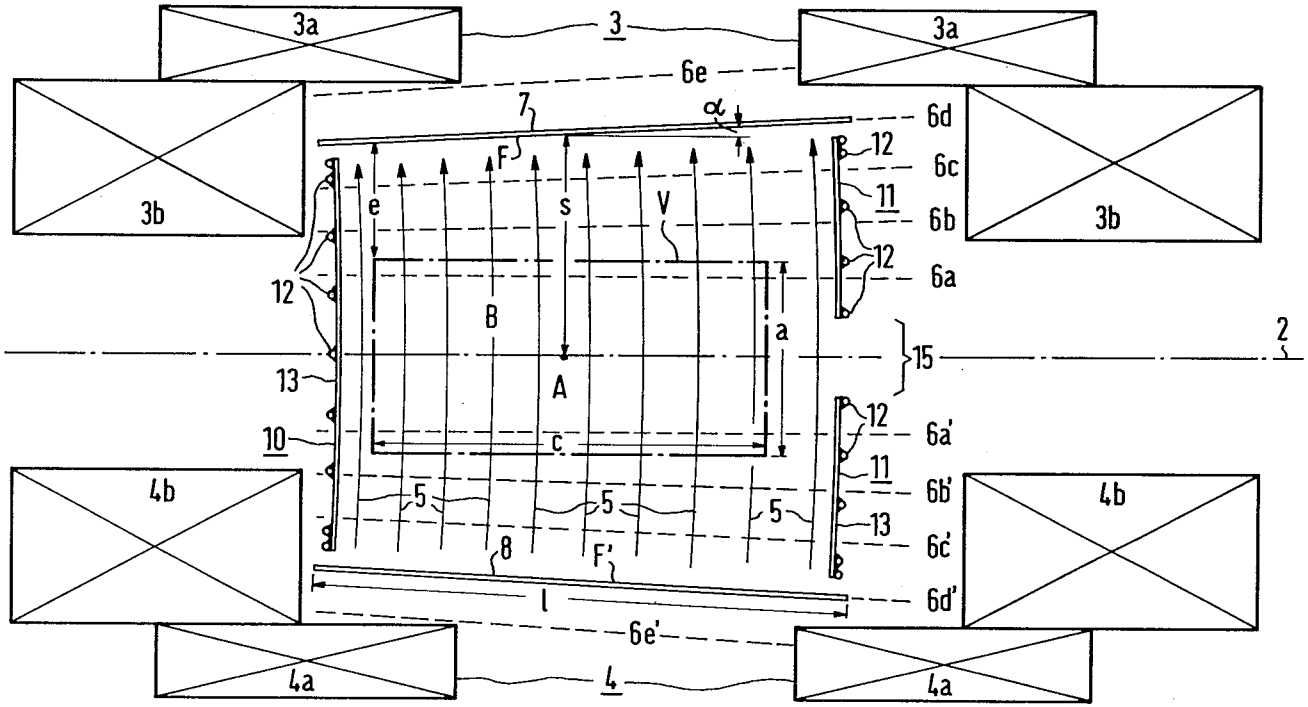
FIG. 1 shows apparatus for generating a magnetic field according to the invention.

With reference now to the drawings, FIG. 1 schematically illustrates a cross section through a magnetic field-generating apparatus such as can be used for an electron storage ring. The dipole magnet required therefor is likewise curved due to the curved particle track and may in particular be bent in the shape of a semicircle (see, for instance, the mentioned publication "IEEE Trans. Nucl. Sci."). Because of the required high field strengths, its windings are preferably made of superconducting material.

With the magnetic apparatus, a dipole magnetic field B of predetermined intensity and having a predetermined field line pattern should be capable of being generated in a useful volume V about the beam-guiding axis A. To this end, the apparatus comprises on both sides of the beam guiding plane 2 containing the beam guiding axis A and symmetrically to this plane, dipole windings 3 and 4, each having a main winding 3*a*, 4*a* and a secondary winding 3*b*, 4*b*. These windings serve for generating the dipole field B which is illustrated in the figure by its field lines designated with arrows 5 as well as some equipotential lines 6*a* to 6*e* and 6*a'* to 6*e'* shown dashed.

In order to assure the desired shape of the field lines 5 within narrow error-field limits of, for instance, 1 per mil, magnetic boundary conditions are created about the useful volume V according to the invention which unambiguously determine the field pattern in the entire interior of the useful volume. For this purpose, a surface portion is determined outside the useful volume V on opposite sides with respect to this volume which represents a magnetic equipotential surface of the desired field. According to the embodiment shown, the equipotential surfaces 6*d* and 6*d'* of each of these surface portions is covered by a thin plate-shaped body 7 and 8 of a material with a preferably high permeability. These plate-shaped bodies 7 and 8 can, for instance, be corresponding ferro-magnetic metal sheets. The relative permeability of these sheets, for instance, 0.5 to 10 mm thick, should be at least 1500 and preferably at least 2000. This condition is met, for instance, by NiFe alloys with a high nickel content such as permalloys. The surfaces F and F', respectively, of these sheets facing the useful volume V are therefore to be shaped and arranged such that they come to lie on a magnetic equipotential surface of the magnetic field to be generated in the useful volume such as on the surfaces 6*d* and 6'd, respectively. The sheets 7 and 8 are advantageously attached in the vicinity of the useful volume V. Preferably, the smallest distance e from the useful volume V should be smaller than the corresponding dimension a of the useful volume in this direction. In addition, the geometric extent of the surface portions to be covered by the metal sheets 7 and 8 are advantageously chosen so that the field lines 5 of the field V pass at least largely through these surface portions.

In order to limit the penetration of interference fields from the sides not covered by the sheets 7 and 8 into the useful volume V to a minimum, the dimension 1 of the sheets transverse to the beam guiding axis A would have to be made relatively large, i.e., for instance, at least correspond to the sum of the dimension c of the useful volume V in this transverse direction and of the average distance s between the sheets. Such a magnitude of the dimension 1, however is sometimes practically impossible due to the arrangement of the individual windings.

In order to prevent the lateral penetration of interference fields also for smaller dimensions 1, where 1 is always at least slightly larger than the corresponding dimension c of the useful volume, additional grid or screen-like structures of predetermined dimension can be advantageously provided with wire or ribbon shaped superconductors at the open sides of the useful volume V. Each grid-like structure designated in the figure with 10 or 11 is shaped and arranged so that it follows the field lines of the magnetic field B to be generated in the useful volume V. These structures 10 and 11 advantageously extend directly to the sheets 7 and 8 without touching them, however. The superconductors of these structures designated with 12 are arranged parallel to each other and extend perpendicularly to the field lines 5 of the magnetic field B. At least at their ends, and possibly also in between with spacing, they are connected in an electrically conducting manner in the direction of the field lines by metallic parts 13. With the choice of the material for these parts 13 and their number, a predetermined L/R time constant $\tau$ can then be chosen for each structure 10 and 11 designed in screen fashion. Since, for changes of an interference field component in time, corresponding shielding currents are automatically induced in the superconductors, interference fields themselves are largely shielded especially when starting from a field B=0 and an L/R time constant $\tau$ of the grid-like structure, if $\tau$ is very much larger than the field rise time.

The field forming or shielding measures shown in FIG. 1 therefore comprise, as seen in the cross section, a rectangle surrounding the useful cross section where two opposite sides are formed by the ferro-magnetic sheets 7 and 8, and the two other sides of a screen-like structure 10 and 11 with superconductors 12. All four sides are electrically insulated from each other. In order to avoid eddy currents in the ferro-magnetic metal shields 7 and 8, they may optionally be slotted or provided with other measures suitable therefor. At the corners formed between a metal sheet and a screenlike structure, the outside contours are perpendicular to each other. If a homogeneous field is required, a rectangle with parallel sides is formed by the metal sheets and the structures. If, however, a gradient or a higher multipole is required, then the sides each form two segments of groups of hyperbolas orthogonal to each other. For small gradient admixtures, they can also be approximated with good approximation by two plane ferromagnetic plates with an angle of inclination to each other as well as by two screens on circular segments. Such a case is the basis of the embodiment according to FIG. 1 where a negative field gradient$(r/B)\cdot dB/dr = -0.5$ was assumed. The angle of inclination $\alpha$ of the metal sheets 7 and 8 relative to the beam guidance plane 3 is about 3°.

As further shown in FIG. 1, the screen-like structure 11 can further be provided with a lateral opening 15 so that the synchrotron radiation emitted in the region of the curved particle track can get to the outside unimpeded.

Figure 2:
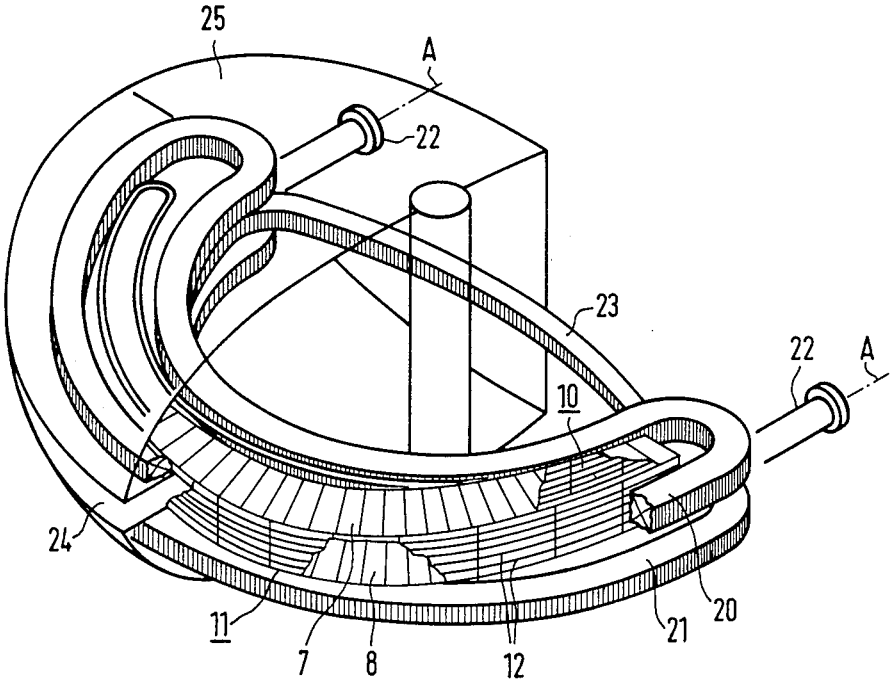
FIG. 2 shows such a magnetic-field generating device which forms a part of an electron accelerator. Like parts in the figures are provided with like reference symbols.

In FIG. 2, a curved dipole deflection magnet of an electron accelerator is shown in an oblique view, partly in a schematic broken-apart presentation. This magnet has two large curved dipole windings 20 and 21 which are arranged on both sides parallel to each other along the beam guiding axis A. Along the curved inside of the magnet and the electron beam tube 22, there is further an additional gradient winding 23. Since the conductors of these windings 20, 21 and 23 consist of superconducting material, the radiation chamber 24 which is divided in two for reasons of bringing out the synchrotron radiation is provided with a suitable helium housing 25. As shown in the side elevation, ferro-magnetic sheets 7 and 8 have shapes matched to the curvature of the tube 22 and are arranged above and below the electron beam tube 22. Between the inside edges and the outside edges of these sheets there are screen-like structures 10 and 11 containing superconducting wires 12.

By these sheets 7 and 8 and the screen-like structures 10 and 11, the cross sections of which are shown in FIG. 1, interference fields due to eddy current effects as well as the residual magnetization of the superconductor of the windings can be shielded in the fast-pulsed small-field region. The interference field shielding follows the curved particle track over the entire length of the magnet and is open only at the ends. The dimensions of the cross section are, for instance, $9\times9$ cm$^2$. The magnetic walls comprise, for instance, $\mu$-metal 0.5 to 1 mm thick. The screen-like structures 10 and 11 have each at least three superconducting multifilament wires which are connected every 10 cm by perpendicular copper wires and by copper ribbons at their ends. The L/R time constant $\tau$ of these structures can be much larger than the pulse rise time.

The field-forming and screening measures according to the invention are effective particularly for small fields and high field change rates. For large fields with $\dot{B}$ larger than 1T, and small field change rates B, the measures described are largely without effect because then the highly permeable material is saturated and the shielding currents induced in the wires become small. In a manner known per se, the main windings of the magnetic apparatus alone then take over the shaping of the field.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. Apparatus for generating a magnetic field having a spatially predetermined field pattern in a useful volume in the interior of a chamber in a curved section of a track of an electrically charged particle accelerator, comprising a plurality of field generating windings in said curved section of the track and further comprising at least one thin plate-shaped body of ferro-magnetic material influencing the field pattern and being disposed on each of the two opposite sides and outside of the useful volume, each of said plate-shaped bodies having predetermined geometric extent and comprising a material having high permeability, surfaces of the plate-shaped bodies facing the useful volume being shaped and arranged so that said surfaces lie in planes defined by magnetic equipotential surfaces of the magnetic field to be generated in the useful volume.

2. The apparatus recited in claim 1, wherein the smallest distance of each plate-shaped body from the useful volume is smaller than the corresponding extent of the useful volume in the same direction.

3. The apparatus recited in claim 1, wherein a transverse dimension of each plate-shaped body is larger than the corresponding extent of the useful volume in the same direction.

4. The apparatus recited in claim 1, wherein the geometric extent of the surface sections of the equipotential surfaces to be covered by one of the plate-shaped bodies is chosen large enough so that the field lines of the magnetic field passing through the useful volume substantially pass through these surface sections.

5. The apparatus recited in claim 1, further comprising first means of predetermined extent comprising wire-or ribbon-shaped superconductors disposed outside of and on opposite sides of the useful volume, each first means being shaped and arranged so that it follows the field lines of the magnetic field to be generated in the useful volume, the superconductors being aligned perpendicularly to the field lines and being connected at least at their ends to electrically conducting parts extending in the direction of the field lines.

6. The apparatus recited in claim 5, wherein the electrically conducting parts comprise material which is electrically normal-conducting at the operating temperature of the superconductors.

7. The apparatus recited in claim 5, wherein the superconductors are connected also in regions between their ends to electrically conducting parts which extend in the direction of the field lines of the magnetic field to be generated in the useful volume.

8. The apparatus recited in claim 5, wherein the choice of material of and the number of the electrically conducting parts determines a L/R time constant for the first means.

9. The apparatus recited in claim 5, wherein the extent and the arrangement of the first means are chosen so that said first means extend between the plate-shaped bodies.

10. The apparatus recited in claim 1, further comprising means for reducing eddy currents in the plate-shaped bodies.

11. The apparatus recited in claim 5, wherein said first means comprises a screen or grid like structure.

* * * * *